US005226251A

United States Patent [19]

Webb

[11] Patent Number: 5,226,251

[45] Date of Patent: Jul. 13, 1993

[54] ROLLING ADS' VIEWER

[76] Inventor: William J. Webb, 3329 Colonel Rd., Richmond, Ky. 40475

[21] Appl. No.: 705,414

[22] Filed: May 24, 1991

[51] Int. Cl.[5] ..... G09F 11/30

[52] U.S. Cl. ..... 40/508; 40/345

[58] Field of Search ..... 40/508, 509, 489, 342, 40/345; 221/259; 271/272, 145, 207; 206/39.4, 449

[56] References Cited

U.S. PATENT DOCUMENTS

| | | | |
|---|---|---|---|
| 138,877 | 5/1873 | French | 40/345 |
| 535,635 | 3/1895 | Stone | 40/509 |
| 627,402 | 6/1899 | Einbigler | 40/503 |
| 709,466 | 9/1902 | Butt | 40/611 |
| 922,272 | 5/1909 | Garrod | 206/39.4 |
| 985,383 | 2/1911 | Weener et al. | 40/509 |
| 1,652,664 | 12/1927 | Frasier | 40/209 |
| 1,674,264 | 6/1928 | Prather | 40/611 |
| 1,829,824 | 11/1931 | Forrester | 40/209 |
| 1,842,170 | 1/1932 | Helfrich | 206/39.4 |
| 1,995,984 | 3/1935 | Hudson | 40/209 |
| 2,592,289 | 4/1952 | Joyner | 40/588 |
| 3,154,216 | 10/1964 | Snow et al. | 221/259 |
| 3,173,219 | 3/1965 | Yarder | 40/591 |
| 3,449,849 | 6/1969 | Pasquale et al. | 40/343 |
| 3,481,059 | 12/1969 | Lowmaster | 40/643 |
| 3,510,975 | 5/1970 | Lowmaster | 40/129 |
| 3,771,243 | 11/1973 | Rolph | 40/591 |
| 3,826,026 | 7/1974 | Bevan | 40/503 |
| 4,044,710 | 8/1977 | Hansen | 116/316 |
| 4,094,083 | 6/1978 | Fund | 40/536 |
| 4,106,229 | 8/1978 | Schmid | 40/611 |
| 4,123,863 | 11/1978 | Becker | 40/152 |
| 4,282,667 | 8/1981 | Glade | 40/649 |
| 4,715,138 | 12/1987 | Cherico | 40/591 |
| 4,891,895 | 1/1990 | DeLaquil, Jr. | 40/209 |

FOREIGN PATENT DOCUMENTS

| | | | |
|---|---|---|---|
| 1042413 | 11/1953 | France | 40/345 |
| 14717 | of 1890 | United Kingdom | 40/345 |
| 2021945 | 12/1979 | United Kingdom . | |

*Primary Examiner*—Kenneth J. Dorner
*Assistant Examiner*—Cassandra Hope
*Attorney, Agent, or Firm*—Sughrue, Mion, Zinn, Macpeak & Seas

[57] ABSTRACT

An advertisement frame into which poster advertisements can be inserted is attached to the rear or side of a semitrailer. The advertisement frame includes a unitary main frame portion, a plexiglass protective cover and a roller assembly. The roller assembly is mounted at the bottom of the main frame and constitutes a mechanism for feeding and removing posters into and from the frame.

12 Claims, 3 Drawing Sheets

FIG. 1
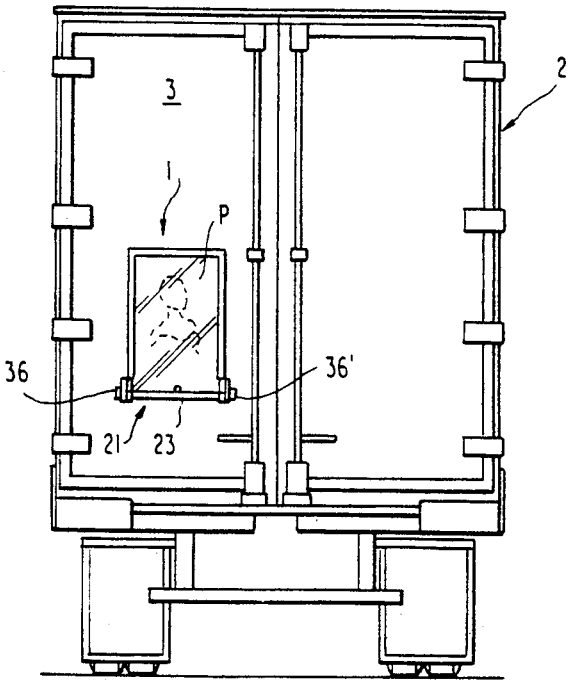
FIG. 4
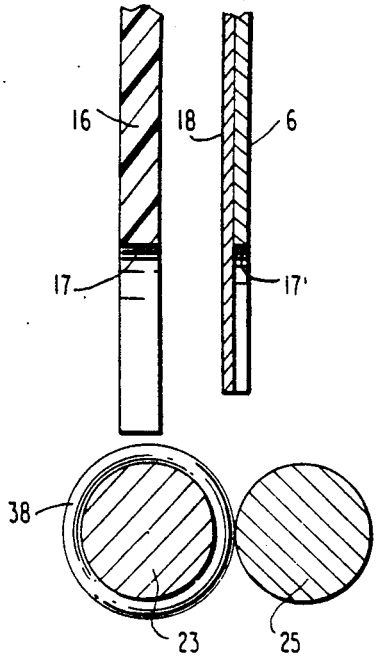
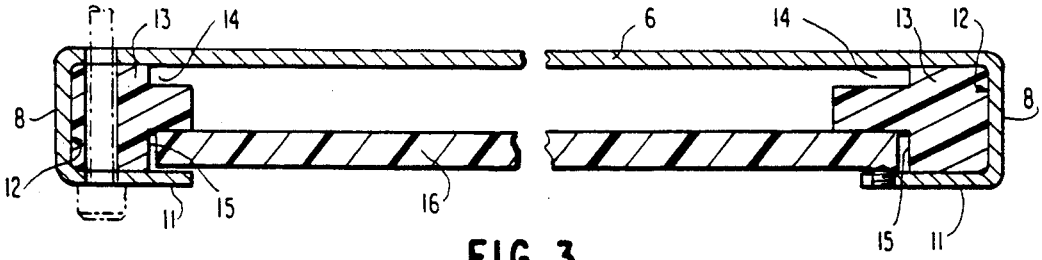
FIG. 3
FIG. 6
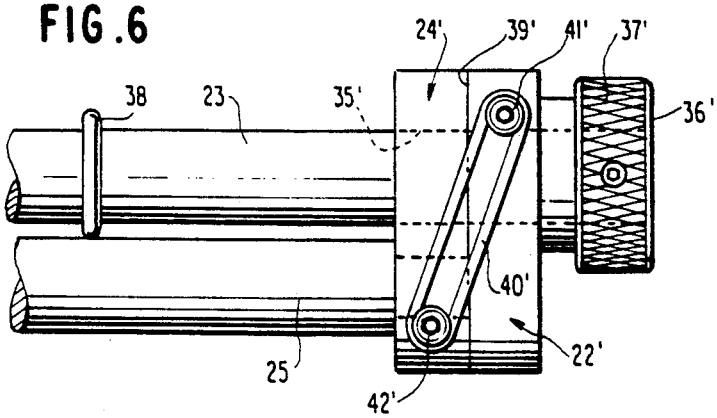

ROLLING ADS' VIEWER

BACKGROUND OF THE INVENTION

1. Field of the Invention

My invention provides an advertisement frame into which poster advertisements can be inserted and, in particular, an advertisement frame which is attached to vehicles such as semitrailers.

2. Description of Related Art

U.S. Pat. No. 4,715,138 (Cherico) discloses a truck placard holder comprised of a plastic frame, a plexiglass cover and a pivoted closure.

U.S. Pat. No. 4,123,863 (Becker) discloses a quick-change picture frame having moldings which may be fabricated from wood, metal or aluminum.

U.S. Pat. Nos. 4,891,895 (DeLaquil, Jr.) and 1,652,664 (Frasier) disclose license plate holders having gaskets and a packing, respectively.

U.S. Pat. No. 535,626 (Stone) discloses a message and card receiver including a shaft on which two friction disks and a knob are mounted.

U.S. Pat. No. 985,383 (Weener et al.) discloses an advertising device having roller-members for carrying a placard into a semi-circular casing 9 and then to a display opening 8.

U.S. Pat. Nos. 627,402 (Einbigler) and 4,044,710 (Hansen) are cited to show further indicator displays.

U.S. Pat. Nos. 1,995,984 (Hudson), 3,826,026 (Bevan), 3,771,243 (Rolph), 4,106,229 (Schmid), 3,510,975 (Lowmaster), 3,173,219 (Yarder), 4,094,083 (Fund), 2,592,289 (Joyner), 3,481,059 (Lowmaster) and 1,829,824 (Forrester) relate to display devices for displaying printed material on the outside of a vehicle.

U.K. Patent Application No. 2,021,945A and U.S. Pat. Nos. 709,466 (Butt), 1,674,264 (Prather) and 4,282,667 (Glade) relate to advertising frames in general.

SUMMARY OF THE INVENTION

It is an object of the present invention to provide an advertisement frame which is attached to vehicles such as semitrailers and in which poster advertisements can be inserted.

The advertisement frame is mounted on the rear or side of semitrailers and may be employed to display an advertisement, logo, etc. Accordingly, before each shipment of freight leaves the shipping dock, a user can insert a poster or sign identifying or advertising their own goods or product on the semitrailer of the freight carrier. As the freight carrier transports the user's goods or product to its designated delivery destination, the user's advertisement will be viewed by producers, consumers and manufacturers along the way.

In particular, the advertisement frame includes a main frame having a back wall portion and top, left and right side wall portions which may be pressed from a unitary piece of aluminum. The top and the two side wall portions are bent such that a thin border is formed which is visible when the frame is viewed from the front. A plexiglass protective cover is inserted into the frame and fixed thereto. A roller assembly means is mounted at the bottom of the main frame and constitutes a mechanism for feeding and removing posters into and from the frame. The roller assembly means includes right and left front roller housings for rotatably mounting opposite ends of a front roller and right and left rear roller housings for rotatably mounting opposite ends of a rear roller. The front roller housings can be loosened to thereby raise the front roller with respect to the rear roller.

BRIEF DESCRIPTION OF THE DRAWINGS

Other features and advantages of the present invention will be apparent from the following description taken in connection with the accompanying drawings wherein:

FIG. 1 is a plan view of the advertisement frame according to the present invention, shown in use on the rear of a semitrailer;

FIG. 3 is a cross sectional view of the frame of FIG. 2 along the lines 3A—3A;

FIG. 4 is a cross sectional view of FIG. 2 along the lines 4A—4A;

FIG. 6 is a bottom fragmentary view of the roller housings on one side of the frame;

DETAILED DESCRIPTION OF THE PREFERRED EMBODIMENT

Figure 2:
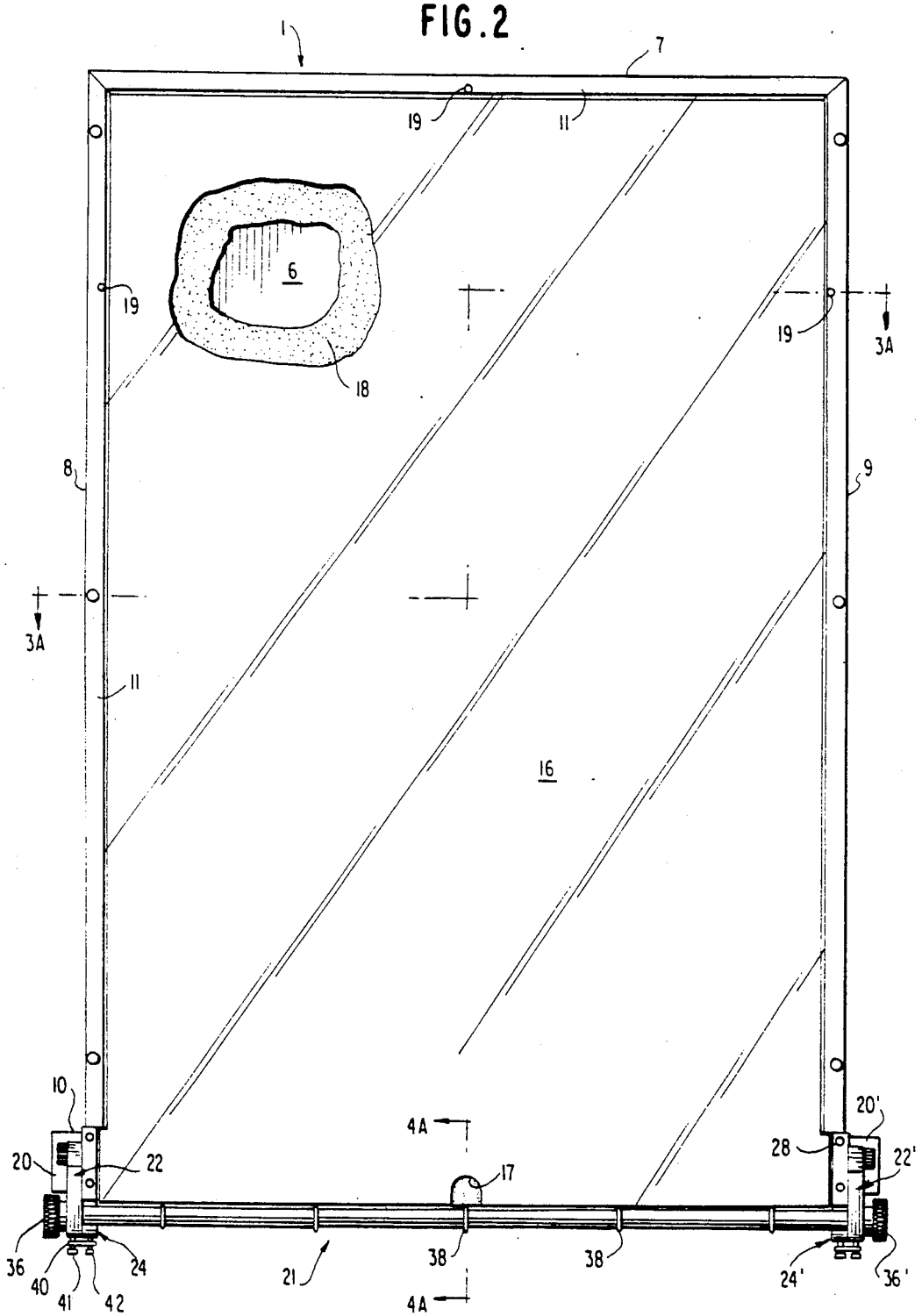
FIG. 2 is a front view of the advertisement frame according to the present invention.

The invention will now be described with reference to the drawings. As shown in FIG. 1, the advertisement frame is generally denoted by the reference numeral 1. The frame 1 is shown mounted at the rear of a semitrailer 2 on one of the doors 3. Of course, the frame could be mounted on the side of the semitrailer 2. A front roller 23 and left and right 36 and 36', which will be described in more detail below, are disposed at the bottom of the frame 1. An advertisement poster P is held within the frame 1.

As best seen in FIG. 2, the main frame 1 includes a back wall 6, a top wall 7, a right side wall 8, a left side wall 9 and a bottom portion 10. The top 7 and right and left side walls 8 and 9, respectively, are preferably formed by bending a single piece of aluminum. The top 7 and sides 8 and 9 are further bent inwardly to form a thin border 11 around the frame 1 and which is visible when the frame 1 is viewed from the front. As seen in FIG. 3, the border 11 cooperates with the respective side or top and the back wall 6 to form a channel 12 around the frame 1, except for the bottom 10.

A strip material 13, such as NYLON, is disposed in the channel 12 around the frame The strip material 13 is fixed in the channel 12 so as to form grooves or slots 14 and 15 for inserting a poster P and a plexiglass protective cover 16, respectively.

The plexiglass cover 16 and back wall 6 include thumb notches 17 and 17' positioned at the bottom and centrally located. The notches 17 and 17' simply facilitate removal of a stationary backing insert 18 which serves as a backing for the poster P (see FIGS. 2 and 4). The plexiglass cover 16 is slid into position within the slots 15 located at the side and top of the frame and is held there by a snug fit and also by small screws 19.

As shown in FIG. 2, the back wall 6 of the frame 1 has flat projecting portions 20, 20' at the bottom 10. The projecting portions 20, 20' serve as support means for mounting and supporting the roller assembly means generally indicated at 21. The roller assembly 21 serves as a means for inserting and removing the poster into and out of the frame 1.

The roller assembly means 21 includes right and left front roller housings 22, 22' for rotatably supporting opposite ends of a front roller 23, and right and left rear roller housings 24, 24' for rotatably supporting opposite ends of a rear roller 25.

Figure 5:
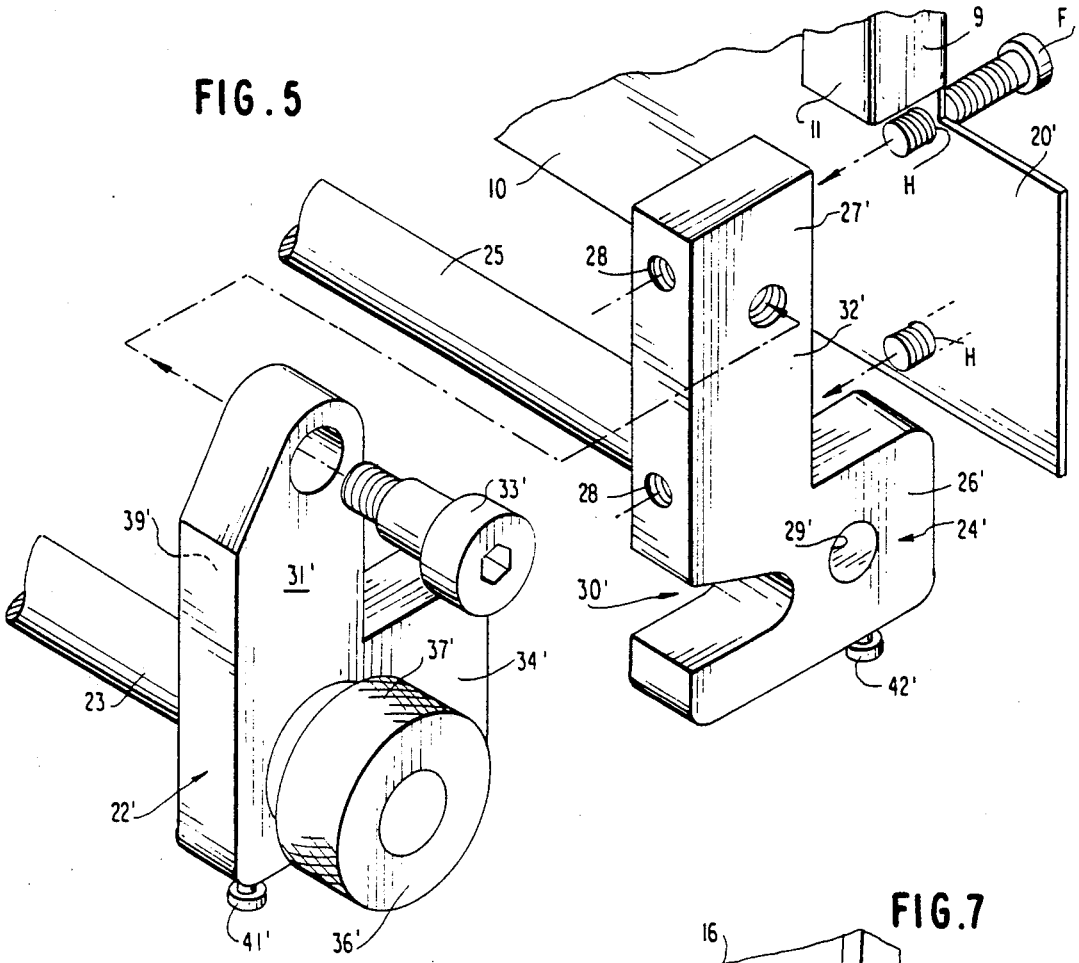
FIG. 5 is an exploded perspective view of the front and rear roller housings on one side of the frame.

As shown in FIGS. 5 (only the roller housings on one side of the frame are shown) and 7, each of the rear roller housings 24, 24' is generally L-shaped. Each of the rear roller housings 24, 24' is mounted to the corresponding right and left projecting portions 20, 20' at the bottom 10 of the frame back wall 6, such that the shorter legs 26, 26' of the L-shaped housings 24, 24' project backwards. The housings 24, 24' are fixed to the projecting portions 20, 20' by means of suitable fasteners F, such as Allen screws. The screws pass through suitable holes H in the back wall 6 and are threaded into threaded bores 28 formed in the longer legs 27, 27' of the housings 24, 24'. The shorter legs 26, 26' of the L-shaped housings 24, 24' each includes an opening 29, 29' toward the rear thereof for rotatably journalling the opposite ends of the rear roller 25. Further, the L-shaped housings 24, 24' each includes a large, generally U-shaped groove 30, 30' (see FIG. 7) for removably receiving the front roller 23 when it is in its lowered position as described in more detail below.

Figure 7:
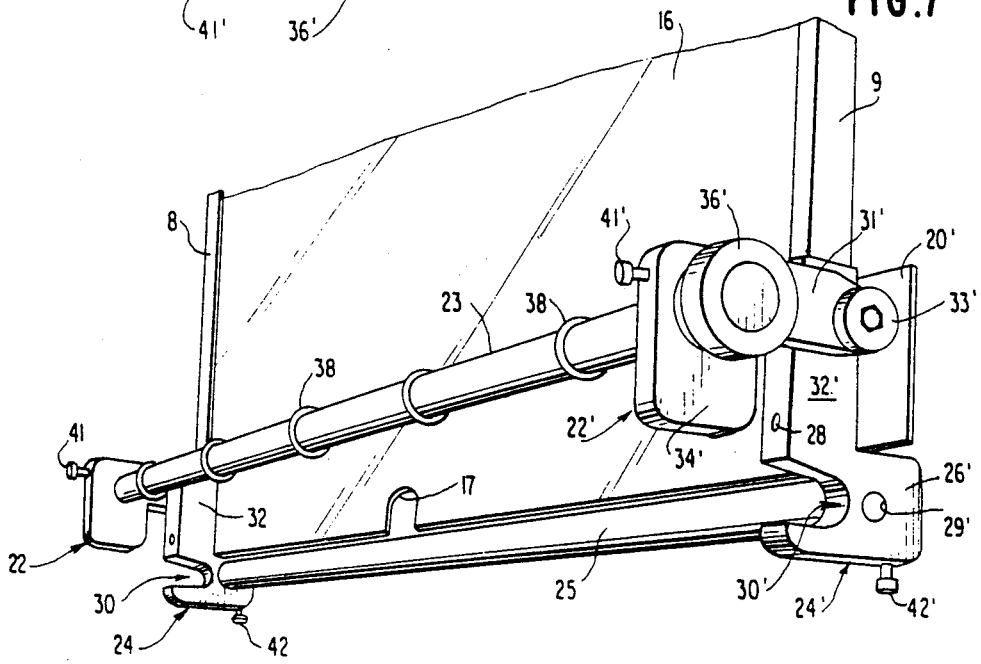
FIG. 7 is a fragmentary perspective view of the frame showing a close up of the rollers, with the front roller rotated away from the rear roller.

As shown in FIGS. 5 and 7, each of the front roller housings 22, 22' is likewise generally L-shaped. The longer legs 31, 31' of each of the L-shaped housings 22, 22' are pivotally mounted to the outer side faces 32, 32' of the longer legs 27, 27' of the corresponding L-shaped rear housings 24, 24' by means of thumb screws 33, 33'. The shorter legs 34, 34' of the L-shaped front roller housings 22, 22' each includes an opening 35, 35' for rotatably journalling the opposite ends of the front roller 23.

Opposite ends of the front roller 23 extend beyond the corresponding openings 35, 35' for a short distance. Knobs 36, 36' having knurled surfaces 37, 37' are fixed to the opposite ends of the front roller 23 which extend outwardly beyond openings 35, 35'. The knobs 36, 36' are manually turned by the user to directly rotate the front roller 23.

A plurality of rubber O-rings 38 (for example, five) are evenly spaced along the front roller 23 and serve as gripper means for gripping the poster P. The O-rings 38 contact the rear roller 25 when the front roller 23 is locked into position (and when there is not a poster between the rollers). Of course, once a poster is inserted between the two rollers 23 and 25, the O-rings 38 contact and grip the poster P.

As shown in FIG. 7 and as noted above, the front roller 23 may be raised away from the rear roller 25, since the front roller housings 22, 22' are pivotally mounted by adjustable thumb screws 33, 33'. By lifting the front roller 23 away from the rear roller 25, adequate space is provided for removal of the poster backing insert 18. When the front roller 23 is lowered to its normal position, small portions of the roller 23, adjacent to the inside faces 39, 39' of each of the front roller housings 22, 22', are nested within the U-shaped grooves 30, 30'. The thumb screws 33, 33' are then manually tightened to thereby lock the front roller 23 relative to the rear roller 25.

Once in the locked position, an elastic means, such as O-rings 40, 40', may be stretched over projecting members 41, 41' and 42, 42' so as to apply a pinching force on the rollers 23 and 25 to pull them tightly together (see FIG. 6). Projecting members 41, 41' may take the form of screws or bolts partially threaded into a bottom portion of each of the front roller housings 22, 22'. The projecting members 42, 42' are likewise screws or bolts but are partially threaded into a bottom portion of each of the rear roller housings 24, 24'. The O-ring 40 is simply stretched over the projecting members 41 and 42, whereas O-ring 40' is stretched over projecting members 41' and 42'.

In use, the advertisement frame 1 is mounted on the rear or side of a semitrailer by means of six cylindrical mounts (not shown) which simply allow the frame 1 to be spaced apart from the surface of the semitrailer. To insert a poster, the user simply aligns a top edge of the poster between the rollers and begins to turn one of the knobs 36, 36' to feed the poster into the frame 1. Once the top portion of the poster is fed between the rollers 23 and 25, the user can then rapidly turn one or both knobs to feed the entire poster P into the frame 1.

To remove the poster P, the rotation direction of the roller 23 is reversed by turning the knob or knobs 36, 36' in the opposite direction.

While it is preferred to make the frame 1, including the rollers, knobs and roller housings, out of aluminum, other suitable materials could likewise be employed, such as plastic.

With the above-described advertisement frame, the user is able to easily display an advertisement, logo, etc. which identifies or promotes their own goods or product on a semitrailer.

It is contemplated that numerous modifications may be made to the advertisement frame of the present invention without departing from the spirit and scope of the invention as defined in the following claims.

What is claimed is:

1. An advertisement frame into which a poster is adapted to be inserted, said advertisement frame adapted to be mounted to a vehicle, said advertisement frame comprising:

a) main frame means including a back wall portion and a plurality of side wall portions which define a channel;

b) a transparent cover means disposed within said channel of said main frame means and being in spaced apart relation with respect to said back wall portion; and c) a roller assembly means for feeding and removing the poster to and from said main frame means, said roller assembly means being mounted to said main frame means along a portion thereof that is devoid of said side wall portions.

2. The advertisement frame according to claim 1, wherein said roller assembly means comprises a front roller, a rear roller, a pair of front roller housings for rotatably mounting opposite ends of said front roller, a pair of rear roller housings for rotatably mounting opposite ends of said rear roller, and at least one manually operated knob fixed to an end of one of said front and rear rollers.

3. The advertisement frame according to claim 2, further comprising a plurality of gripper means for gripping the poster, said gripper means being disposed along one of said front and said rear rollers.

4. The advertisement frame according to claim 1, wherein said main frame means is formed from a single piece of aluminum.

5. The advertisement frame according to claim 2, wherein said pair of front roller housings are selectively pivotally mounted so as to move said front roller away from said rear roller.

6. An advertisement frame into which a poster is adapted to be inserted said advertisement frame being mounted to a vehicle, said advertisement frame comprising:

a) a main frame including a back portion, top, left and right side portions, and a bottom portion, said top, left and right side portions having a thin border extending inwardly and substantially parallel with respect to the back portion so as to form a channel along the top, left and right side portions;

b) a transparent protective cover disposed within said channel of said main frame and being in spaced apart relation with respect to said back portion; and c) a roller assembly means for feeding and removing the poster to and from said main frame, said roller assembly means being mounted to said main frame at said bottom portion thereof.

7. The advertisement frame according to claim 6, wherein said roller assembly means comprises a front roller, a rear roller, a pair of front roller housings for rotatably mounting opposite ends of said front roller, a pair of rear roller housings for rotatably mounting opposite ends of said rear roller, and at least one manually operated knob fixed to an end of one of said front and rear rollers.

8. An advertisement frame for displaying posters, said frame being mounted on a rear or side portion of a semitrailer, said frame comprising:

a) a main frame of a generally rectangular shape and having a back wall portion, top, left and right side wall portions, and a bottom portion, said top, left and right side wall portions extending substantially perpendicular with respect to said back wall portion and having a thin border extending inwardly and substantially parallel with respect to said back wall portion so as to form a channel along the top, left and right side wall portions;

b) a strip material lining said channel and defining a front groove between an inner surface of said border and said strip material, and a rear groove between said back wall portion and said strip material;

c) a transparent, protective cover disposed within said front groove so as to be spaced apart from said back wall portion and extending over substantially all of said entire main frame;

d) a roller assembly means for feeding and removing posters respectively to and from said main frame such that edges of a respective poster are disposed within said rear groove, to attendantly display the respective poster from the semitrailer, said roller assembly means comprising right and left rear roller housing members for rotatably mounting opposite ends of a rear roller, said right and left rear roller housing members being mounted to said back wall portion at said bottom portion of said main frame, right and left front roller housing members for rotatably mounting opposite ends of a front roller such that said front roller is positioned directly in front of said rear roller and contacts said rear roller, said right and left front roller housings being mounted to outer side faces of said right and left rear roller housings, respectively, and manually operated knobs fixed on opposite ends of one of said front and said rear rollers.

9. The advertisement frame according to claim 8, further comprising a plurality of O-ring grippers for gripping the respective poster, said O-ring grippers being disposed at regular intervals along one of said front and said rear rollers.

10. The advertisement frame according to claim 8, wherein said main frame is formed from a single piece of aluminum.

11. The advertisement frame according to claim 8, wherein said right and left front roller housings are selectively pivotally mounted so as to move said front roller away from said rear roller.

12. The advertisement frame according to claim 3, wherein said gripper means comprises a plurality of O-rings disposed at regular intervals along one of said front and said rear rollers.

* * * * *